US012409368B2

(12) United States Patent
Hayase et al.

(10) Patent No.: US 12,409,368 B2
(45) Date of Patent: Sep. 9, 2025

(54) GOLF CLUB HEAD

(71) Applicant: Sumitomo Rubber Industries, Ltd., Hyogo (JP)

(72) Inventors: Seiji Hayase, Kobe (JP); Masahide Onuki, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/516,208

(22) Filed: Nov. 1, 2021

(65) Prior Publication Data

US 2022/0152461 A1 May 19, 2022

(30) Foreign Application Priority Data

Nov. 19, 2020 (JP) ..... 2020-192592

(51) Int. Cl.
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08)

(58) Field of Classification Search
CPC ..... A63B 53/0466; A63B 53/0437; A63B 53/0433; A63B 53/0408
See application file for complete search history.

(56) References Cited

U.S. PATENT DOCUMENTS 3,997,170 A * 12/1976 Goldberg ..... A63B 53/04 473/328
4,065,133 A * 12/1977 Gordos ..... A63B 60/52 473/328
4,139,196 A * 2/1979 Riley ..... A63B 53/04 473/345
5,351,958 A * 10/1994 Helmstetter ..... A63B 53/04 473/345
5,467,989 A * 11/1995 Good ..... A63B 53/04 473/305
D371,407 S * 7/1996 Ritchie ..... D21/733
D387,112 S * 12/1997 Fabre, Jr. ..... D21/752
D397,750 S * 9/1998 Frazetta ..... D21/733
5,921,872 A * 7/1999 Kobayashi ..... A63B 53/04 473/345
D434,820 S * 12/2000 Reed ..... D21/744
6,342,018 B1 * 1/2002 Mason ..... A63B 53/0466 473/294
6,605,006 B2 * 8/2003 Mason ..... A63B 60/52 473/331
6,783,465 B2 * 8/2004 Matsunaga ..... A63B 60/52 473/345

(Continued)

FOREIGN PATENT DOCUMENTS

JP 2002136625 A * 5/2002
JP 2005137913 A * 6/2005 ..... A63B 53/0487
JP 4500296 B2 7/2010

*Primary Examiner* — William M Pierce
(74) *Attorney, Agent, or Firm* — Studebaker Brackett PLLC

(57) ABSTRACT

A golf club head is provided with a hollow therein and comprises a face portion, a crown portion, a sole portion, a toe and a heel. One of or each of a toe side and a heel side of the crown portion is provided with a first rigidity-decreasing part which is a groove or a slit and extends in a front-rear direction of the head.

1 Claim, 10 Drawing Sheets

(56) References Cited

U.S. PATENT DOCUMENTS

| | | | | |
|---|---|---|---|---|
| 8,608,587 | B2 * | 12/2013 | Henrikson | A63B 60/52 473/409 |
| 8,641,557 | B2 * | 2/2014 | Kuan | A63B 60/00 473/345 |
| 8,678,946 | B2 * | 3/2014 | Boyd | A63B 53/0466 473/328 |
| 9,144,721 | B2 * | 9/2015 | Golden | A63B 60/00 |
| 9,320,948 | B2 * | 4/2016 | Fossum | A63B 60/00 |
| 9,393,465 | B2 * | 7/2016 | Stokke | A63B 53/0466 |
| 9,908,012 | B2 * | 3/2018 | Larson | A63B 60/54 |
| 9,925,430 | B2 * | 3/2018 | Stokke | A63B 53/0466 |
| 10,695,625 | B2 * | 6/2020 | Henrikson | A63B 53/0466 |
| 10,799,773 | B2 * | 10/2020 | Burnett | A63B 53/0466 |
| 11,266,888 | B2 * | 3/2022 | Kroloff | A63B 53/04 |
| 2008/0096689 | A1 | 4/2008 | Oyama | |
| 2019/0247724 | A1 * | 8/2019 | Shimahara | A63B 53/04 |
| 2022/0062718 | A1 * | 3/2022 | Greaney | A63B 53/0466 |

* cited by examiner s1 cross section

GOLF CLUB HEAD

BACKGROUND OF THE INVENTION

Field of the Invention

The present disclosure relates to a golf club head having a hollow therein.

Background Art

Patent Document 1 below discloses a wood-type golf club head in which the back surface of the face portion is virtually divided into nine regions in a grid pattern and the average thickness of each region is specified. In this golf club head, the effect of expanding the high-repulsion region of the face portion in the toe-heel direction is expected.
Patent Document 1: Japanese Patent No. 4500296

SUMMARY OF THE INVENTION

Problems to be Solved by the Invention

It is an object of the present disclosure to provide a golf club head in which the high-repulsion region of a face portion can be expanded in the toe-heel direction by improving a structure of a crown portion, that is, a different approach than that of Patent Document 1.

Means for Solving the Problems

According to the present disclosure, a golf club head with a hollow therein comprises a face portion, a crown portion, a sole portion, a toe and a heel, wherein the crown portion is provided, in one of or each of a toe side and a heel side thereof, with a first rigidity-decreasing part which is a groove or a slit and extends in a front-rear direction of the head.

Effects of the Invention

In the golf club head according to the present disclosure, the high-repulsion region of the face portion can be expanded in the toe-heel direction by the above configuration.

DETAILED DESCRIPTION OF THE INVENTION

Figure 1:
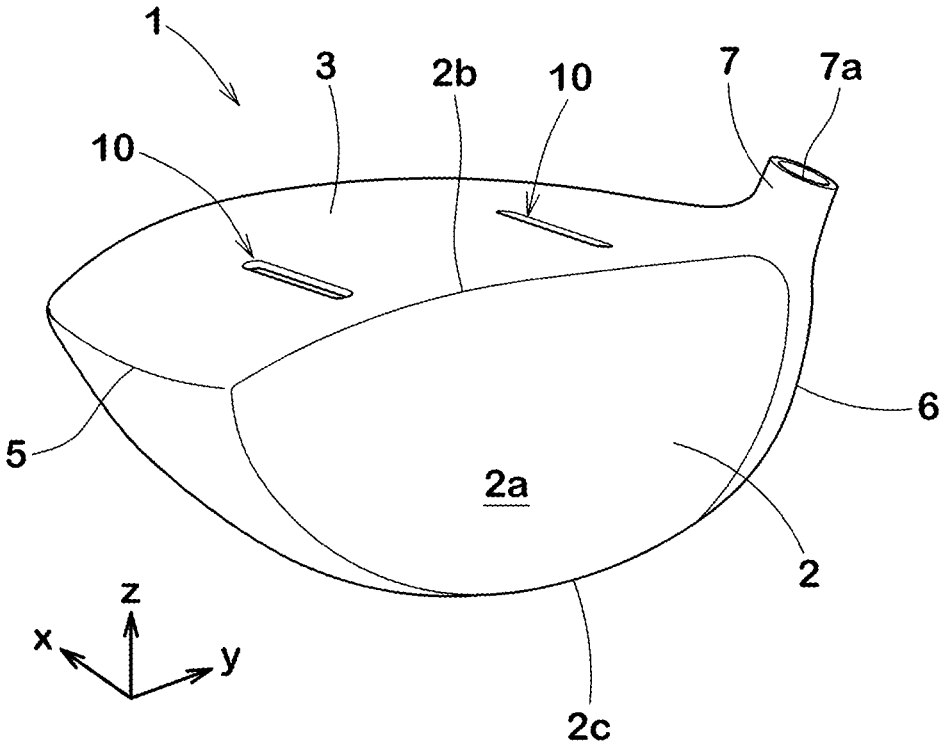
FIG. 1 is a perspective view of a golf club head as an embodiment of the present disclosure.
Figure 2:
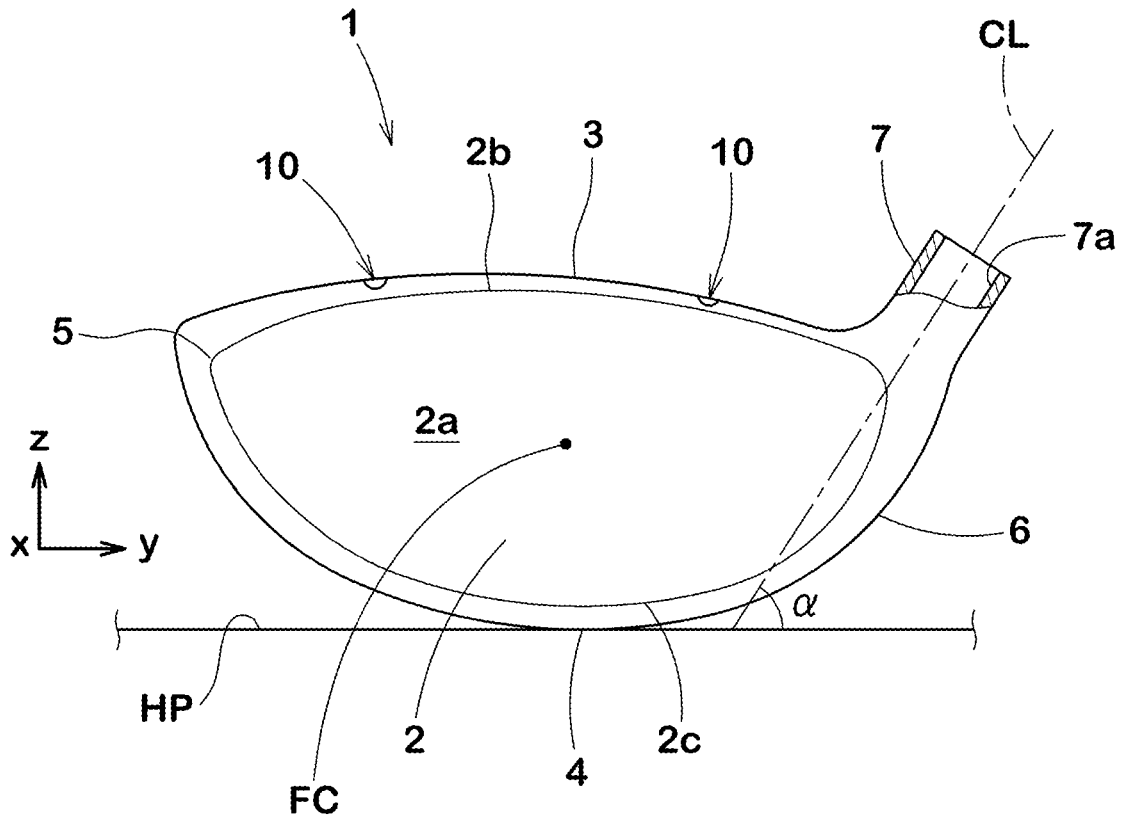
FIG. 2 is a front view of the golf club head.

Embodiments of the present disclosure will now be described in detail in conjunction with accompanying drawings. Throughout all embodiments, the same members or parts are designated by the same reference numerals and duplicate descriptions are omitted.

FIGS. 1 to 4 are a perspective view, a front view, a plan view, and a bottom view, respectively, of a golf club head 1 as an embodiment of the present disclosure.

Reference State

FIGS. 1 to 4 show the head 1 under its reference state. The reference state is such that the head 1 is placed on a horizontal plane HP at the lie angle alpha (FIG. 2) and the loft angle (not shown) specified for the head 1 so that a shaft center line CL of the head 1 lies in a reference vertical plane VP. The shaft center line CL is defined by the center line of a shaft insertion hole 7*a* formed in a hosel portion 7 of the head 1. In this specification, it is premised that the head 1 is placed in this reference state unless otherwise noted.

<Coordinate System of Head>

In this specification, the XYZ coordinate system is associated with the head 1. The X-axis is orthogonal to the reference vertical plane VP and parallel to the horizontal plane HP. The Y-axis is parallel to both the reference vertical plane VP and the horizontal plane HP. The Z-axis is orthogonal to both the X-axis and the Y-axis.

With respect to the head 1, a front-rear direction is a direction parallel to the X-axis, a toe-heel direction is a direction parallel to the Y-axis, and an up-down direction is a direction parallel to the Z-axis.

In the front-rear direction of the head, the side of the face portion 2 is the front side, and the opposite side is the rear side.

<Basic Form of Head>

Figure 3:
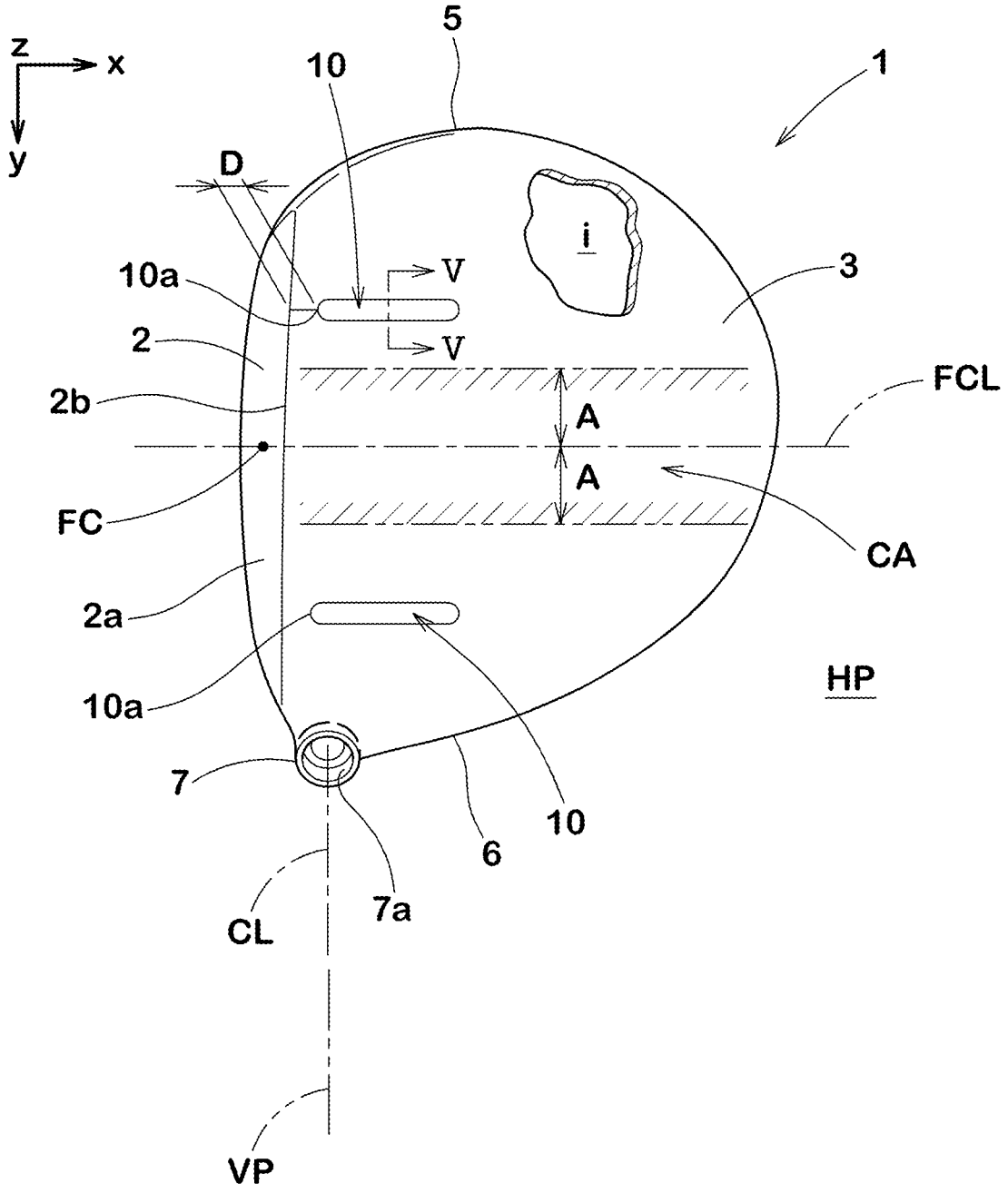
FIG. 3 is a plan view of the golf club head.

The head 1 in the present embodiment has a hollow "i" therein, as shown by being partially broken in FIG. 3.

The hollow "i" may be used as a void space as it is, or a gel agent for the purpose of weight adjustment or the like may be arranged in a part of the hollow "i".

The head 1 in the present embodiment is configured as a wood type, for example. The wood type head 1 includes at least a driver, a fairway wood, a hybrid and the like. The head 1 in the present embodiment is configured as a driver.

The head 1 has, for example, a face portion 2, a crown portion 3, a sole portion 4, a toe 5, and a heel 6 so as to surround the hollow "i".

The face portion 2 is a portion for hitting a ball and is formed on the front side of the head 1. The face portion 2 has a striking surface 2*a*, which is a surface that comes into direct contact with the ball.

Although not shown, face lines may be formed on the striking surface 2*a*. The face lines are grooves extending in the toe-heel direction.

The crown portion 3 extends rearward from the upper edge 2*b* of the face portion 2 so as to form the upper surface of the head. The hosel portion 7 described above is provided on the heel side of the crown portion 3. The hosel portion 7 is provided with the shaft insertion hole 7*a* for fixing a golf club shaft (not shown). The crown portion 3 is a portion excluding the face portion 2 and the hosel portion 7 in the plan view of the head shown in FIG. 3.

Figure 4:
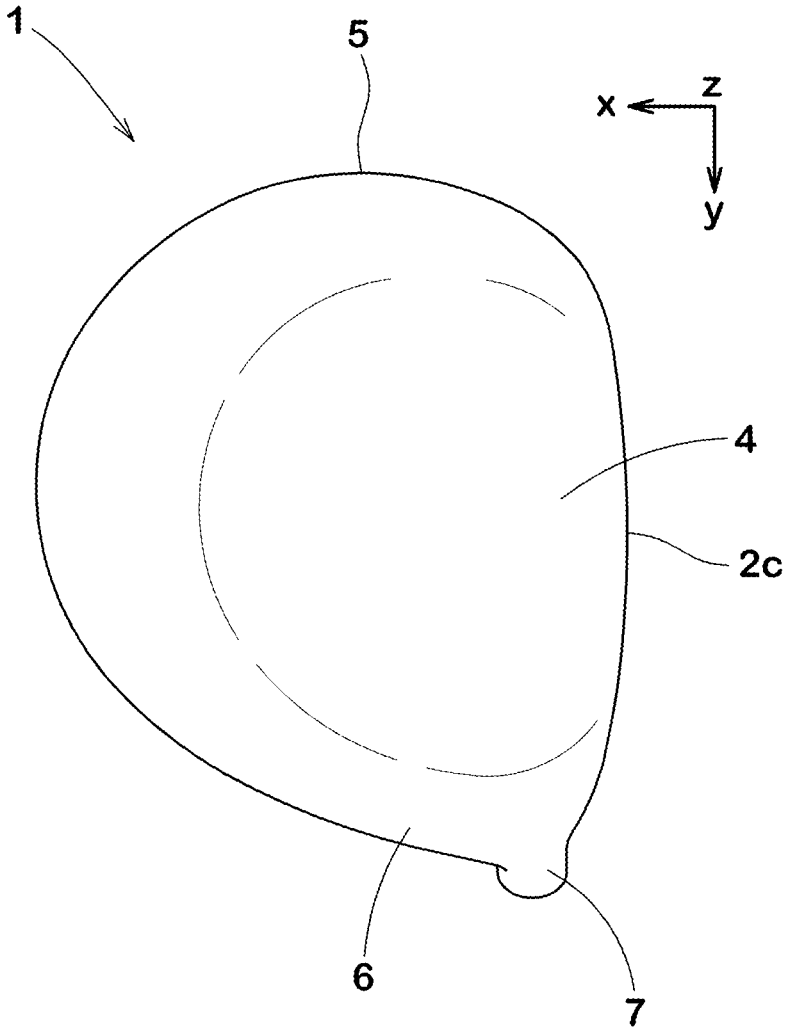
FIG. 4 is a bottom view of the golf club head.

As shown in FIG. 4, the sole portion 4 extends rearward from the lower edge 2*c* of the face portion 2 so as to form the bottom surface of the head. The sole portion 4 is a portion excluding the hosel portion 7 in the bottom view of the head.

The head 1 is made of, for example, a metal material. As the metal material, for example, stainless steel, maraging steel, titanium, titanium alloy, magnesium alloy, aluminum alloy and the like are suitable.

<First Rigidity-Decreasing Part>

In the head 1 in the present embodiment, at least one of a toe 5 side and a heel 6 side of the crown portion 3 is provided with a first rigidity-decreasing part 10.

The first rigidity-decreasing part 10 extends in a front-rear direction of the head.

Figure 5A:
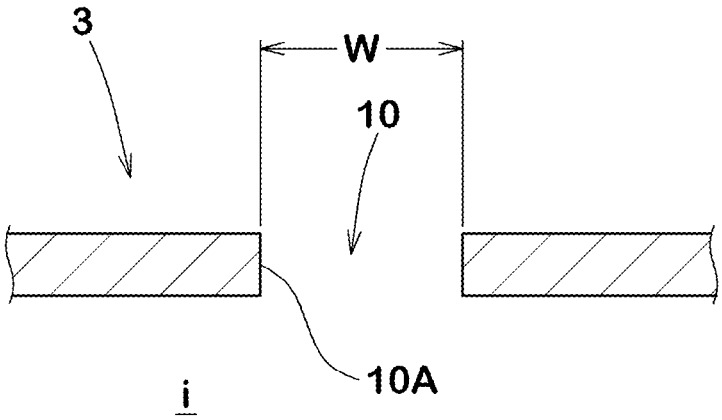
FIG. 5A and FIG. 5B are sectional views of the slit and the groove, respectively, taken along line V-V of FIG. 3.
Figure 5B:
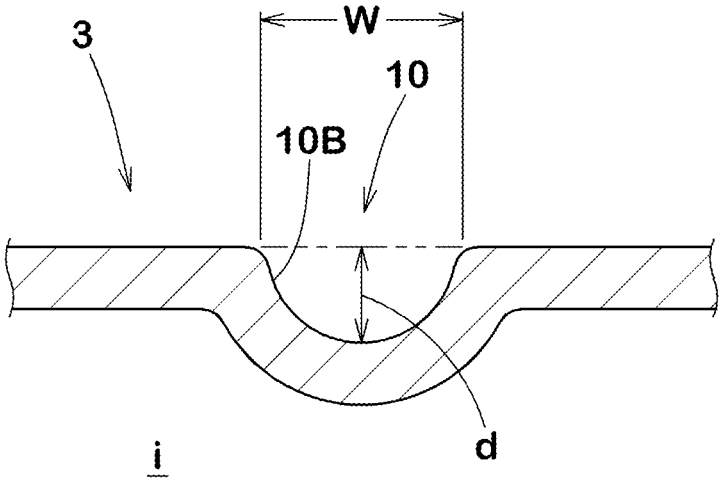

FIGS. 5A and 5B are cross sectional views taken along line V-V of FIG. 3.

The first rigidity-decreasing part 10 may be formed as a slit 10A as shown in FIG. 5A or a groove 10B as shown in FIG. 5B.

Such first rigidity-decreasing part 10 locally reduces the rigidity of the crown portion 3 in the toe-heel direction, and thus makes the crown portion 3 more likely to deflect in the toe-heel direction when hitting a ball.

The slit 10A or the groove 10B may be filled with an elastic body or the like (not shown) in order to keep the outer surface of the crown portion 3 smooth.

As shown in FIG. 5A, the slit 10A as the first rigidity-decreasing part 10 is a through-hole penetrating the crown portion 3 from the outside to inside of the head.

Since the slit 10A does not have rigidity in its position, it is possible to promote the deflection of the crown portion 3 in the toe-heel direction starting from the slit 10A when hitting a ball.

As shown in FIG. 5B, the groove 10B as the first rigidity-decreasing part 10 is a part of the crown portion 3 locally recessed toward the hollow "i" side.

In contrast to the slit 10A, the groove 10B does not penetrate the crown portion 3, but the groove 10B can be used as a starting point to promote the deflection of the crown portion 3 in the toe-heel direction when hitting a ball.

As the first rigidity-decreasing part or parts 10, only the slit(s) 10A, only the groove(s) 10B, or both the slit 10A and the groove 10B may be used.

Operation in the Present Embodiment

When a ball hits the striking surface 2*a* of the face portion 2, the crown portion 3 undergoes a complicated deformation.

For example, when hitting a ball at the face center FC (hereinafter "center hit"), the deformation of the crown portion 3 is such that a central region of the crown portion 3 undergoes a bending deformation in the front-rear direction of the head and a tensile deformation in the toe-heel direction of the head.

Therefore, in order to enhance the rebound resilience at the time of center hit, it is desirable to configure the central region of the crown portion 3 so as to easily bend in the front-rear direction or easily extend in the toe-heel direction. On the other hand, it was found that the extensional deformation in the toe-heel direction was larger than the bending deformation in the front-back direction. Therefore, in order to enhance the rebound resilience at the time of center hit, it is more desirable to configure the central region of the crown portion 3 so as to easily extend in the toe-heel direction.

When hitting a ball at a position off the face center FC to the toe 5 side or the heel 6 side (hereinafter, "toe side hit" and "heel side hit"), the deformation of the crown portion 3 is different from that at the time of center hit, and bending deformation in the front-rear direction and tensile deformation in the toe-heel direction occur around a region near the hitting position. Focusing on such deformation behavior of the crown portion 3, in order to expand the high-repulsion region of the face portion 2 in the toe-heel direction, it is important to make the area of the toe side or the heel side of the crown portion 3 more flexible in the toe-heel direction at the time of toe side hit or heel side hit.

In the present embodiment, based on the above findings, at least one of the toe 5 side and the heel 6 side of the crown portion 3 is provided with the first rigidity-decreasing part 10 extending in the front-rear direction of the head.

Thereby, at the time of toe side hit or heel side hit, the crown portion 3 can greatly deflect in the toe-heel direction starting from the first rigidity-decreasing part 10.

Therefore, in the head 1 in the present embodiment, high repulsion performance can be obtained by greatly deflecting the crown portion 3 even at the time of toe side hit or heel side hit. That is, in the head 1 in the present embodiment, the high-repulsion region can be expanded in the toe-heel direction.

In this specification, the term "face center" means the geometric center of a region bounded by the peripheral edge of the face portion 2.

Figure 10A:
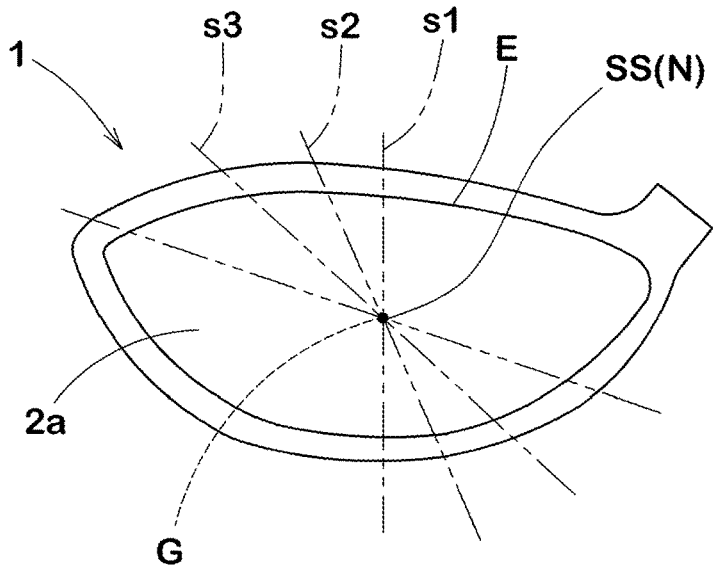
FIG. 10A is a front view of a golf club head.
Figure 10B:
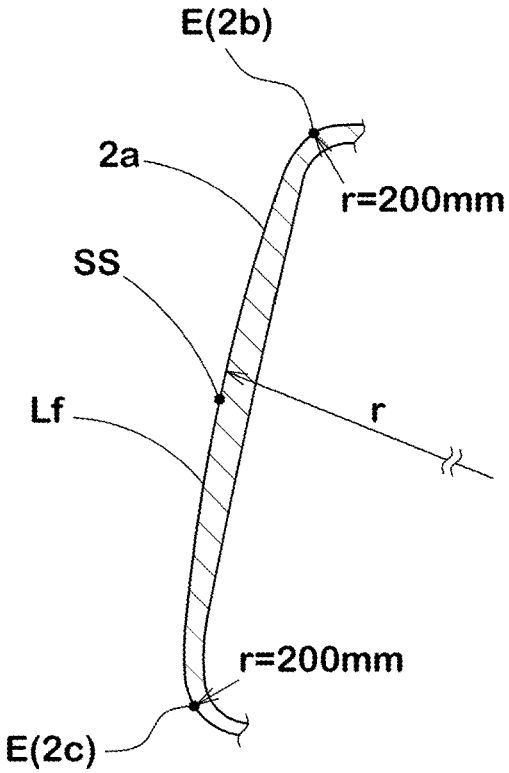
FIG. 10B is a cross-sectional view of the face portion thereof.

If the peripheral edge of the face portion 2 is unclear due to smooth change in the curvature, as shown in FIGS. 10A and 10B, a virtual edge line defined based on the curvature change as follows is used instead. In each cutting plane s1, s2, s3 --- including the sweet spot SS and the center G of gravity of the head, a point E at which the radius (r) of curvature of the profile line Lf of the face portion first becomes under 200 mm in the course from the sweet spot SS to the periphery of the face portion is determined. Then, the virtual edge line is defined as a locus of the points E.

The upper edge 2*b* of the face portion 2 is a portion of the peripheral edge E between the face portion 2 and the crown portion 3. The lower edge 2*c* of the face portion 2 a portion of the peripheral edge E between the face portion 2 and the sole portion 4.

The position of the first rigidity-decreasing part 10 may be determined, for example, according to the striking tendency of the target golfer of the head 1.

For example, for a golfer whose striking tendency show a mixture of a toe-side hit and a heel-side hit, such a head 1 that each of the toe 5 side and the heel 6 side of the crown portion 3 is provided with at least one first rigidity-decreasing part 10 as shown in FIG. 3, may be provided.

In the example of FIG. 3, each of the toe 5 side and the heel side of the crown portion 3 is provided with one first rigidity-decreasing part 10.

As another example, each of the toe 5 side and the heel 6 side of the crown portion 3 may be provided with a plurality of first rigidity-decreasing parts 10 separated from each other in the toe-heel direction by a distance.

Figure 6:
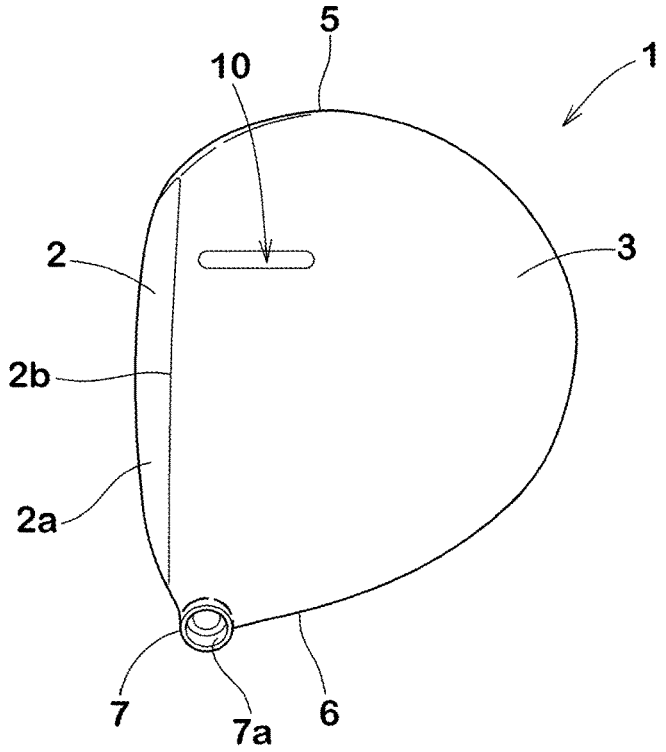
FIG. 6 is a plan view of a golf club head as another embodiment of the present disclosure.

For a golfer whose striking tendency show mainly a toe side hit, such a head 1 that only the toe 5 side of the crown portion 3 is provided with at least one first rigidity-decreasing part 10 as shown in FIG. 6, may be provided.

As a result, the flight distance of a ball when the golfer hits the ball on the toe side can be effectively increased.

In the example of FIG. 6, one first rigidity-decreasing part 10 is disposed on the toe 5 side of the crown portion 3.

As another example, the toe 5 side of the crown portion 3 may be provided with a plurality of first rigidity-decreasing parts 10 separated from each other in the toe-heel direction by a distance.

Figure 7:
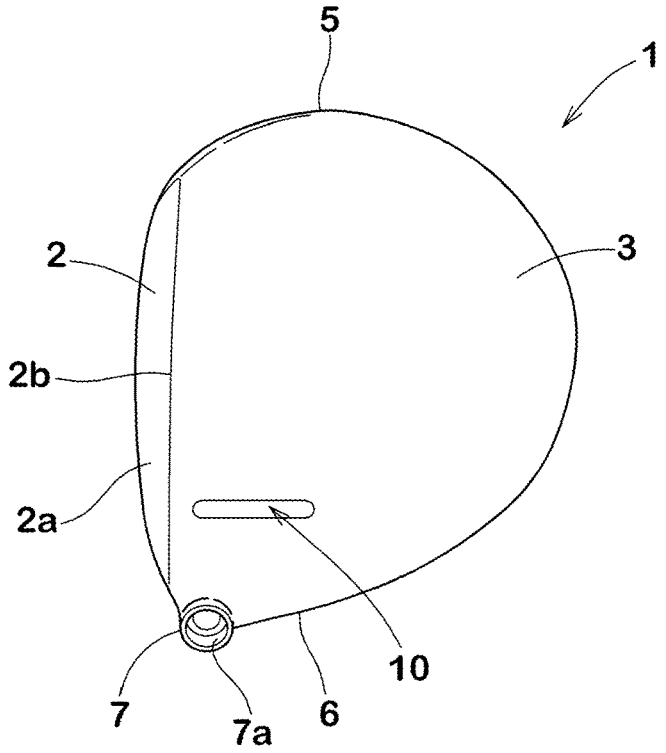
FIG. 7 is a plan view of a golf club head as still another embodiment of the present disclosure.

For a golfer whose striking tendency show mainly a heel side hit, such a head 1 that only the heel 6 side of the crown portion 3 is provided with at least one first rigidity-decreasing part 10 as shown in FIG. 7, may be provided.

As a result, the flight distance of a ball when the golfer hits the ball on the heel side can be effectively increased.

In the example of FIG. 7, one first rigidity-decreasing part 10 is disposed on the heel 6 side of the crown portion 3.

As another example, the heel 6 side of the crown portion 3 may be provided with a plurality of first rigidity-decreasing parts 10 separated from each other in the toe-heel direction by a distance.

<Angle of First Low Rigidity Part>

Figure 8:
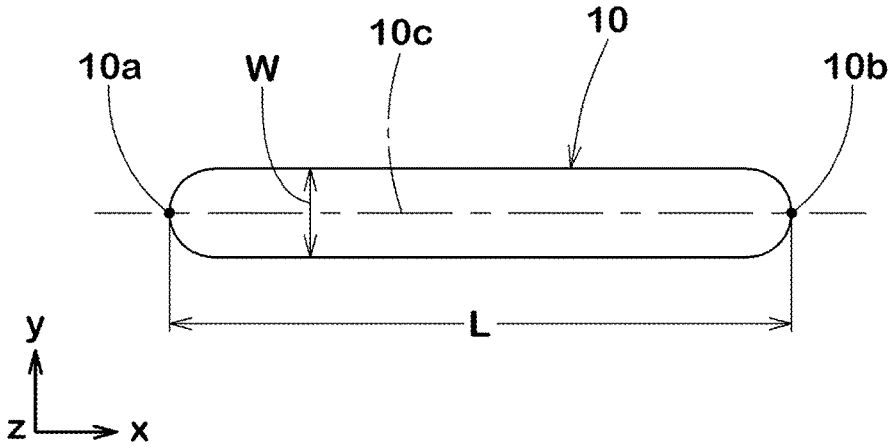
FIG. 8 is an enlarged view of the first rigidity-decreasing part of FIG. 3.

FIG. 8 shows an enlarged view of the first rigidity-decreasing part 10 shown in FIG. 3. In the plan view of the head, the first rigidity-decreasing part 10 has a front end 10*a* and a rear end 10*b* in the front-rear direction of the head, and a reference straight line 10*c* passing through the front end 10*a* and the rear end 10*b* is defined.

It is preferable that, in the plan view of the head, an angle of the reference straight line 10*c* with respect to the front-rear direction (that is, the X-axis) is 15 degrees or less.

Such first rigidity-decreasing part 10 can effectively promote the deflection of the crown portion 3 in the toe-heel direction at the time of hitting a ball on the toe side or on the heel side.

In order to more effectively promote the deflection of the crown portion 3 in the toe-heel direction, the angle of the reference straight line 10*c* of the first rigidity-decreasing part 10 is set to be 10 degrees or less, more preferably 5 degrees or less.

When the reference straight line 10*c* is inclined with respect to the front-rear direction of the head, the inclining direction of the reference straight line 10*c* is not particularly limited.

Figure 9:
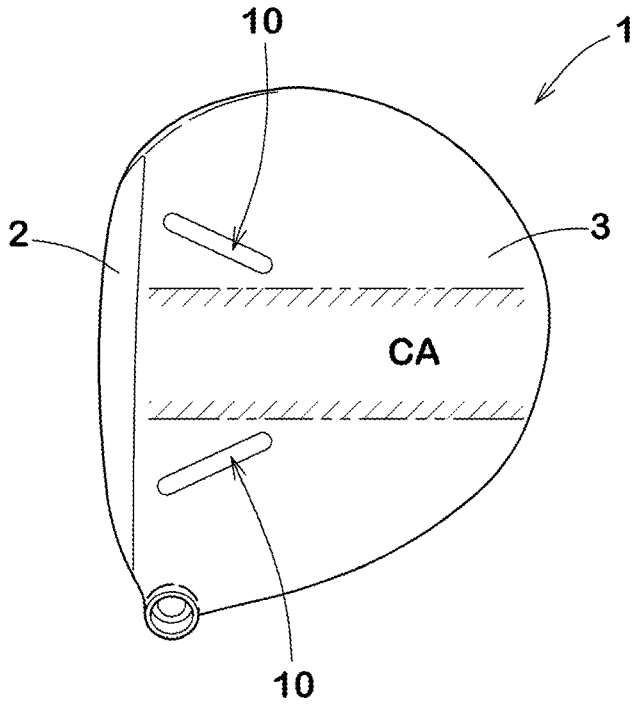
FIG. 9 is a plan view of a golf club head as yet still another embodiment of the present disclosure.

However, for example, as shown in FIG. 9, when the first rigidity-decreasing part 10 is inclined so as to approach the central region of the crown portion 3 toward the rear of the head, it is desirable in that the deflection of the crown portion 3 in the toe-heel direction is promoted more.

In the present embodiment, the first rigidity-decreasing part 10 extends linearly in parallel with the front-rear direction of the head.

However, the first rigidity-decreasing part 10 may have a non-linear shape such as an arc shape, a zigzag shape, a wavy shape and the like.

<Position of the First Rigidity-Decreasing Part in the Toe-Heel Direction>

As shown in FIG. 3, in the plan view of the head, when the central region CA of the crown portion 3 is defined as extending by a range A of 15 mm toward the toe side and a range A of 15 mm toward the heel side from a straight line FCL passing through the face center FC in parallel with the front-rear direction, it is desirable that the first rigidity-decreasing part 10 is disposed on the toe side or heel side of the central region CA.

As a result of various analyzes by the inventors, it was found that, when the striking position deviates from the face center FC to the toe side or the heel side, the deflection of the crown portion 3 in the toe-heel direction becomes larger on the toe side or the heel side than the central region CA. Therefore, by providing the first rigidity-decreasing part 10 at such a position, the high-repulsion region of the face portion 2 can be further expanded in the toe-heel direction.

The central region CA of the crown portion 3 is a region where the deformation is large at the time of center hit. Therefore, even if the first rigidity-decreasing part 10 is provided in such central region, the high-repulsion region of the face portion 2 cannot be expanded in the toe-heel direction, but rather the repulsion performance at the time of center hit is improved.

On the other hand, recent golf club heads tend to have sufficiently high repulsion performance (for example, performance just the upper limit of the golf rule) at the time of center hit due to the wall thickness distribution design of the face portion 2.

In the present embodiment, since the repulsion performance at the time of center hit is sufficiently enhanced, the first rigidity-decreasing part 10 is not provided in the central region CA of the crown portion 3.

<Dimensions of the First Rigidity-Decreasing Part, Etc.>

In order to effectively promote the deflection of the crown portion 3 in the toe-heel direction by the first rigidity-decreasing part 10, the width W of the first rigidity-decreasing part 10 in the toe-heel direction is, for example, 1 mm or more, preferably 2 mm or more, more preferably 3 mm or more.

On the other hand, if the width W of the first rigidity-decreasing part 10 becomes large, the durability of the crown portion 3 may decrease. Therefore, the width W is, for example, 10 mm or less, preferably 8 mm or less, more preferably 6 mm or less.

The width W of the first rigidity-decreasing part 10 may be constant or may be changed. Further, as shown in FIGS. 5A and 5B, the width W of the first rigidity-decreasing part 10 is the opening width in the case of the slit 10A and as the groove width in the case of the groove 10B.

When the first rigidity-decreasing part 10 is the groove 10B, the depth "d" thereof is, for example, 1 mm or more, preferably 3 mm or more, more preferably 5 mm or more in order to effectively promote the deflection of the crown portion 3 in the toe-heel direction.

Further, from the viewpoint of ensuring the durability of the crown portion 3, the depth "d" of the groove 10B is, for example, 15 mm or less, preferably 12 mm or less, more preferably 10 mm or less.

In order to effectively promote the deflection of the crown portion 3 in the toe-heel direction by the first rigidity-decreasing part 10, the length L (see FIG. 8) of the first rigidity-decreasing part 10 in the front-rear direction is, for example, 10 mm or more, preferably 12 mm or more, more preferably 15 mm or more.

On the other hand, if the length L of the first rigidity-decreasing part 10 becomes large, the durability of the crown portion 3 may decrease. Therefore, the length L is, for example, 30 mm or less, preferably 25 mm or less, more preferably 20 mm or less.

<Distance of the First Rigidity-Decreasing Part from the Face>

As shown in FIG. 3, the distance D in the front-rear direction from the front end 10*a* of the first rigidity-decreasing part 10 to the upper edge 2*b* of the face portion 2 is preferably in a range from 0 to 20 mm.

From the viewpoint of the durability of the face portion 2, the distance D is preferably 2 mm or more, more preferably 5 mm or more, still more preferably 7 mm or more, yet still more preferably 9 mm or more. However, if the distance D exceeds 20 mm, the effect of promoting the deflection of the crown portion 3 in the toe-heel direction by the first rigidity-decreasing part 10 may be reduced.

From this point of view, the distance D is preferably 18 mm or less, more preferably 16 mm or less.

Other Embodiment

Figure 11:
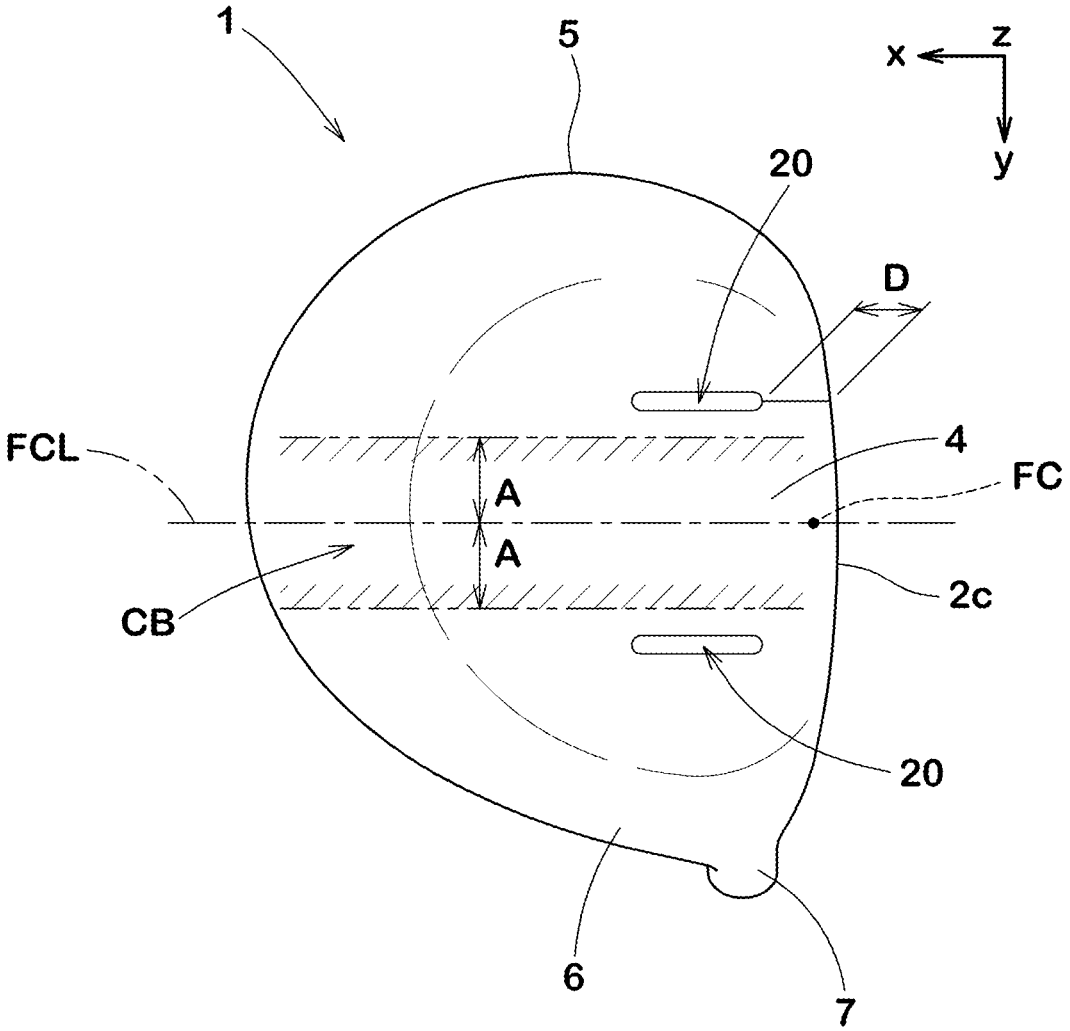
FIG. 11 is a bottom view of a golf club head as yet still another embodiment of the present disclosure.

Next, a head 1 as another embodiment will be described. In the head 1 in this embodiment, the crown portion 3 is provided with the first rigidity-decreasing part 10 as shown in FIG. 3, and further, at least one of the toe 5 side and the heel 6 side of the sole portion 4 is provided with at least one second rigidity-decreasing part 20 formed by a groove or a slit as shown in FIG. 11. The second rigidity-decreasing part 20 extends in a front-rear direction of the head.

When a ball hits the striking surface 2*a* of the face portion 2, the sole portion 4 deflects.

Although the deflection of the sole portion 4 is smaller than that of the crown portion 3, the sole portion 4 behaves very similar to the crown portion 3.

That is, at the time of center hit, the deformation of the sole portion 4 is such that the central region of the sole portion 4 undergoes a bending deformation in the front-rear direction and a tensile deformation in the toe-heel direction.

Therefore, in order to enhance the rebound resilience at the time of center hit, it is desirable to configure the central region of the sole portion 4 so as to be easily bent in the front-rear direction or to be easily extended in the toe-heel direction.

It is more desirable to configure the central region of the sole portion 4 so as to be easily extended in the toe-heel direction.

On the other hand, at the time of toe-side hit or heel-side hit, the deformation of the sole portion 4 is different from that at the time of center hit, and bending deformation in the front-rear direction and tensile deformation in the toe-heel direction occur around a region near the hitting position.

And it was found that the tensile deformation in the toe-heel direction is larger than the bending deformation in the front-back direction.

Focusing on such deformation behavior of the sole portion 4, in order to expand the high-repulsion region of the face portion 2 in the toe-heel direction, it is desirable that, at the time of toe-side hit or heel-side hit, the sole portion 4 easily deflects in the toe-heel direction.

In the head 1 in this embodiment, based on the above findings, at least one of the toe 5 side and the heel 6 side of the sole portion 4 is provided with at least one second rigidity-decreasing part 20 extending in a front-rear direction of the head.

As a result, the sole portion 4 can be greatly deflects in the toe-heel direction starting from the second rigidity-decreasing part 20 at the time of toe side hit or heel side hit.

Therefore, the head 1 in this embodiment can obtain even higher repulsion performance by greatly deflecting the sole portion 4 at the time of toe side hit or heel side hit.

That is, in the head 1 in this embodiment, the high-repulsion region can further expand in the toe-heel direction.

The configuration of the first rigidity-decreasing part 10 described above can be applied to the second rigidity-decreasing part 20 as it is. That is, the slit 10A and the groove 10B as shown in FIGS. 5A and 5B and as described above may be used as the second rigidity-decreasing part 20. Further, as to the dimensions (width, length), formation position, angle, number, and the like of the second rigidity-decreasing part 20, those described in the first rigidity-decreasing part 10 can be adopted.

While detailed description has been made of preferable embodiments of the present disclosure, the present disclosure can be embodied in various forms without being limited to the illustrated embodiments.

Working Example

Next, more detailed examples of the present disclosure will be described.

Figure 12:
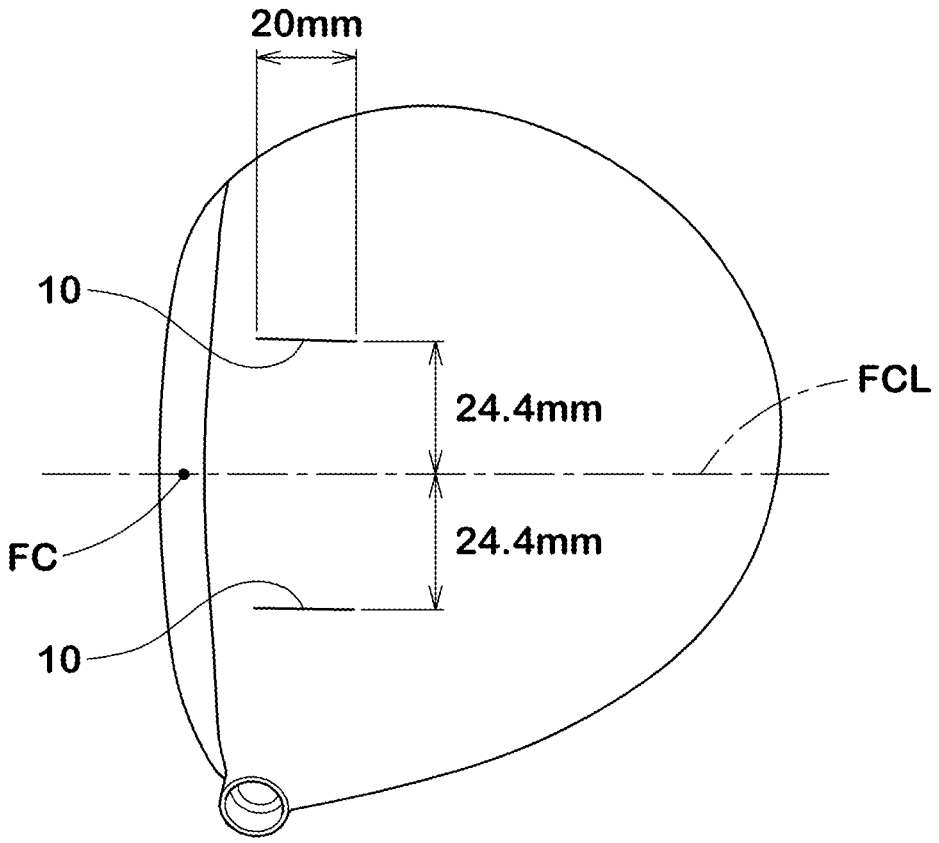
FIG. 12 is a plan view of a finite element model of the golf club head shown in FIG. 3.

Taking up a golf club head as an embodiment provided with one first rigidity-decreasing part on each of the toe side and the heel side of the crown portion, a finite element model thereof was created as shown in FIG. 12. Then, at various positions on the striking surface of the face portion, the coefficient of restitution (COR) was calculated by computer simulation.

The specifications of the golf club head are as follows.

Specifications of Working Example

First rigidity-decreasing part: The first rigidity-decreasing part was a slit having a length of 20 mm, and extending parallel to the toe-heel direction at each of positions separated from the face center by 24.4 mm toward the toe and 24.4 mm toward the heel as shown in FIG. 12. The width of each slit was zero which was achieved by not sharing the nodes of the finite element model at the position of the slit.

The distance D was 12 mm.

The material of the head was titanium alloy.

The volume of the head was 460 cc.

The mass of the head was 172 g.

The thickness of the face portion was 3.7 mm in the center and 2.1 mm in the periphery, and the thickness was changed smoothly between the center and the periphery.

Comparative Example

Further, a finite element model of a comparative example was created by modifying the above-mentioned finite element model such that each slit was eliminated by sharing the nodes at the position of the slit.

In the finite element model of the comparative example, in order to standardize the coefficient of restitution at the face center between the working example and the comparative example, the thickness of the face portion was set to 3.4 mm at the center, which was thinner than that of the working examples, otherwise the comparative example was the same as the working example.

<Coefficient of Restitution (COR)>

According to the "Interim Procedure for Measuring the Coefficient of Restitution of an Iron Clubhead Relative to a Baseline Plate Revision 1.3 Jan. 1, 2006" provided by the USGA (United States Golf Association), the coefficient of restitution was calculated.

The simulation results are shown in Table 1-Table 3.

TABLE 1

| COR of comparative example | | | | | | | | | | | | |
|---|---|---|---|---|---|---|---|---|---|---|---|---|
| | | <- toe | | | | | center | | | heel -> | | |
| | | −25 | −20 | −15 | −10 | −5 | 0 | 5 | 10 | 15 | 20 | 25 |
| upside | 15 | 0.749 | 0.770 | 0.787 | 0.800 | 0.809 | 0.813 | 0.814 | 0.809 | 0.800 | 0.789 | 0.775 |
| | 10 | 0.763 | 0.784 | 0.801 | 0.814 | 0.822 | 0.825 | 0.824 | 0.817 | 0.805 | 0.788 | 0.767 |
| | 5 | 0.766 | 0.788 | 0.805 | 0.818 | 0.826 | 0.830 | 0.829 | 0.822 | 0.811 | 0.794 | 0.772 |

TABLE 1-continued

| COR of comparative example | | | | | | | | | | | | |
|---|---|---|---|---|---|---|---|---|---|---|---|---|
| | | <- toe | | | | | center | heel -> | | | | |
| | | −25 | −20 | −15 | −10 | −5 | 0 | 5 | 10 | 15 | 20 | 25 |
| center | 0 | 0.759 | 0.782 | 0.799 | 0.812 | 0.821 | 0.824 | 0.823 | 0.817 | 0.806 | 0.790 | 0.768 |
| | −5 | 0.740 | 0.764 | 0.782 | 0.795 | 0.804 | 0.808 | 0.807 | 0.801 | 0.790 | 0.774 | 0.752 |
| | −10 | 0.711 | 0.735 | 0.754 | 0.768 | 0.778 | 0.782 | 0.781 | 0.775 | 0.764 | 0.748 | 0.727 |
| downside | −15 | 0.695 | 0.709 | 0.725 | 0.736 | 0.744 | 0.749 | 0.749 | 0.745 | 0.737 | 0.728 | 0.721 |

TABLE 2

| COR of working example | | | | | | | | | | | | |
|---|---|---|---|---|---|---|---|---|---|---|---|---|
| | | <- toe | | | | | center | heel -> | | | | |
| | | −25 | −20 | −15 | −10 | −5 | 0 | 5 | 10 | 15 | 20 | 25 |
| upside | 15 | 0.751 | 0.773 | 0.789 | 0.802 | 0.810 | 0.815 | 0.815 | 0.811 | 0.803 | 0.792 | 0.777 |
| | 10 | 0.764 | 0.785 | 0.801 | 0.814 | 0.822 | 0.826 | 0.824 | 0.818 | 0.807 | 0.790 | 0.769 |
| | 5 | 0.767 | 0.789 | 0.805 | 0.818 | 0.826 | 0.830 | 0.829 | 0.822 | 0.811 | 0.795 | 0.773 |
| center | 0 | 0.760 | 0.782 | 0.799 | 0.812 | 0.821 | 0.824 | 0.823 | 0.817 | 0.806 | 0.790 | 0.769 |
| | −5 | 0.741 | 0.765 | 0.783 | 0.797 | 0.805 | 0.809 | 0.808 | 0.802 | 0.791 | 0.775 | 0.752 |
| | −10 | 0.712 | 0.737 | 0.756 | 0.770 | 0.779 | 0.783 | 0.782 | 0.776 | 0.765 | 0.749 | 0.728 |
| downside | −15 | 0.696 | 0.711 | 0.726 | 0.738 | 0.746 | 0.751 | 0.751 | 0.747 | 0.738 | 0.728 | 0.721 |

TABLE 3

| (working example COR - comparative example COR) × 1000 | | | | | | | | | | | | |
|---|---|---|---|---|---|---|---|---|---|---|---|---|
| | | <- toe | | | | | center | heel -> | | | | |
| | | −25 | −20 | −15 | −10 | −5 | 0 | 5 | 10 | 15 | 20 | 25 |
| upside | 15 | 2.4 | 2.5 | 2.2 | 1.8 | 1.6 | 1.5 | 1.6 | 2.1 | 2.5 | 2.6 | 2.1 |
| | 10 | 1.2 | 1.2 | 0.9 | 0.6 | 0.6 | 0.6 | 0.9 | 1.3 | 1.9 | 2.3 | 1.9 |
| | 5 | 0.7 | 0.6 | 0.2 | −0.1 | −0.1 | −0.1 | 0.0 | 0.3 | 0.7 | 1.0 | 0.9 |
| center | 0 | 0.8 | 0.8 | 0.5 | 0.2 | 0.0 | 0.0 | −0.1 | 0.0 | 0.2 | 0.5 | 0.4 |
| | −5 | 1.1 | 1.3 | 1.3 | 1.1 | 1.0 | 0.8 | 0.6 | 0.5 | 0.5 | 0.6 | 0.4 |
| | −10 | 1.2 | 1.5 | 1.7 | 1.8 | 1.9 | 1.7 | 1.3 | 1.0 | 0.9 | 0.8 | 0.6 |
| downside | −15 | 1.1 | 1.3 | 1.5 | 1.8 | 2.0 | 1.9 | 1.6 | 1.2 | 0.9 | 0.9 | 0.7 |

Table 1 and Table 2 show the COR values of Comparative Example (without slits) and the COR values of Working Example (with slits), respectively.

In each Table, the matrix means the COR values of respective square regions when the striking surface of the face portion was divided in the toe-heel direction and the up-down direction at intervals of 5 mm.

Each COR value shown is the average of four COR values obtained at the four corners of each square region, and the larger the value, the better the repulsion performance.

In the tables, the raw data obtained by the simulation were rounded to three decimal places.

Table 3 shows differences of the COR values of Working Example from the COR values of Comparative Example, namely, the values (×1000) obtained by subtracting the COR values of the comparative example from the respective COR values of the working example with respect to the respective corresponding regions.

Incidentally, the differences were calculated using the raw data obtained through the simulations, and then each value was multiplied by 1000 and, in the Table 3, rounded to one decimal place. The positive value means that the COR was increased, and the larger the value, the better the repulsion performance.

As can be seen from Table 3, it was confirmed that the high-repulsion region of the face portion of the working example was expanded in the toe-heel direction as compared with the comparative example.

Statement of the Present Disclosure

The present disclosure is as follows.

Disclosure 1. A golf club head with a hollow therein, comprising a face portion, a crown portion, a sole portion, a toe and a heel, wherein one of or each of a toe side and a heel side of the crown portion is provided with a first rigidity-decreasing part which is a groove or a slit and extends in a front-rear direction of the head.

Disclosure 2. The golf club head according to Disclosure 1, wherein each of the toe side and the heel side of the crown portion is provided with one or a plurality of the first rigidity-decreasing parts.

Disclosure 3. The golf club head according to Disclosure 1 or 2, wherein in the plan view of the head, the first rigidity-decreasing part has a front end and a rear end in the front-rear direction of the head, and a reference straight line passing through the front end and the rear end has an angle of 15 degrees or less with respect to the front-rear direction of the head.

Disclosure 4. The golf club head according to any one of Disclosures 1 to 3, wherein in the plan view of the head, the first rigidity-decreasing part is disposed on a toe side or a heel side of a central region of the crown portion, wherein the central region is defined as extending by 15 mm toward the toe side and 15 mm toward the heel side from a straight line passing through a face center in parallel with the front-rear direction of the head.

Disclosure 5. The golf club head according to any one of Disclosures 1 to 4, wherein the width of the first rigidity-decreasing part in a toe-heel direction of the head is 1 to 10 mm.

Disclosure 6. The golf club head according to any one of Disclosures 1 to 5, wherein the length of the first rigidity-decreasing part in the front-rear direction of the head is 10 to 30 mm.

Disclosure 7. The golf club head according to any one of Disclosures 1 to 6, wherein the first rigidity-decreasing part has a front end in the front-rear direction of the head, a distance in the front-rear direction from the front end to an upper edge of the face portion is not more than 20 mm.

Disclosure 8. The golf club head according to any one of Disclosures 1 to 7, wherein at least one of a toe side and a heel side of the sole portion is provided with a second rigidity-decreasing part which is a groove or a slit and extends in the front-rear direction of the head.

Disclosure 9. The golf club head according to Disclosure 8, wherein each of the toe side and the heel side of the sole portion is provided with one or a plurality of the second rigidity-decreasing parts.

Disclosure 10. The golf club head according to Disclosure 8 or 9, wherein in a plan view of the head, the second rigidity-decreasing part is disposed on a toe side or a heel side of a central region of the sole portion, wherein the central region is defined as extending by 15 mm toward the toe side and 15 mm toward the heel side from a straight line passing through the face center in parallel with the front-rear direction of the head.

DESCRIPTION OF THE REFERENCE SIGNS

1 head
2 face portion
2*b* upper edge
3 crown portion
4 sole portion
5 toe
6 heel
10 first rigidity-decreasing part
10A slit
10B groove
10*a* front end
10*b* rear end
10*c* reference straight line
20 second rigidity-decreasing part

The invention claimed is:

1. A golf club head with a hollow therein, comprising a face portion, a crown portion, a sole portion, a toe and a heel, and a hosel portion with a shaft insertion hole, wherein in a plan view of the golf club head, a rigidity-decreasing part which is a groove is disposed on each of a toe side and a heel side of a central region of the crown portion, and not disposed in the central region, the groove being a recess formed on the outer surface of the crown portion without penetrating through the crown portion to have a bottom and an opening at the outer surface of the crown portion, and having a depth from the opening to the bottom, the depth being larger than a thickness of the crown portion and 1 mm or more but 15 mm or less, wherein the plan view is a view when the golf club head in a reference state is viewed above the head in an up-down direction of the head, the reference state is such that the golf club head is placed on a horizontal plane at a lie angle and a loft angle specified for the golf club head so that a center line of the shaft insertion hole lies in a vertical plane, the up-down direction is a direction orthogonal to the horizontal plane, the central region of the crown portion is defined as extending by 15 mm toward the toe and 15 mm toward the heel from a straight line passing through a face center of the face portion in parallel with a front-rear direction of the head, the face center is the geometric center of a region of the face portion bounded by the peripheral edge of the face portion, and the front-rear direction is a direction orthogonal to the vertical plane, wherein in the plan view the golf club head, the shape of said groove as the rigidity-decreasing part consists of:

a pair of parallel straight edges of the groove, one of which is a heel-side straight edge and the other of which is a toe-side straight edge, each of these two straight edges having a front end and a rear end;

a front semicircular edge of the groove joining the front ends of these two straight edges; and a rear semicircular edge of the groove joining the rear ends of these two straight edges, and a maximum width of said groove as the rigidity-decreasing part in a toe-heel direction of the head defined between the parallel straight edges of the groove is 1 mm or more but 8 mm or less, the toe-heel direction being a direction orthogonal to the up-down direction and the front-rear direction, wherein in the plan view of the head, said groove as the rigidity-decreasing part has an extreme front end in the front semicircular edge and an extreme rear end in the rear semicircular edge, a straight line drawn between the extreme front end and the extreme rear end has an angle of 15 degrees or less with respect to the front-rear direction of the head, the length of said groove as the rigidity-decreasing part in the front-rear direction is 10 to 30 mm so that the rigidity-decreasing part is larger in the front-rear direction than in the toe-heel direction, and a distance in the front-rear direction from the extreme front end to an upper edge of the face portion is not less than 5 mm but not more than 20 mm, wherein in a bottom view of the golf club head, a rigidity-decreasing part which is a groove is disposed on each of a toe side and a heel side of a central region of the sole portion, and not disposed in the central region, the groove being a recess formed on the outer surface of the sole portion without penetrating through the sole portion to have a bottom and an opening at the outer surface of the sole portion, and having a depth from the opening to the bottom, the depth being larger than a thickness of the sole portion and 1 mm or more but 15 mm or less, wherein the bottom view is a view when the golf club head in the reference state is viewed below the head in the up-down direction of the head, the central region of the sole portion is defined as extending by 15 mm toward the toe and 15 mm toward the heel from the straight line passing through a face center of the face portion in parallel with a front-rear direction of the head, wherein in the bottom view of the golf club head, the shape of said groove as the rigidity-decreasing part consists of:

a pair of parallel straight edges of the groove, one of which is a heel-side straight edge and the other of which is a toe-side straight edge, each of these two straight edges having a front end and a rear end;

a front semicircular edge of the groove joining the front ends of these two straight edges; and a rear semicircular edge of the groove joining the rear ends of these two straight edges, and a maximum width of said groove as the rigidity-decreasing part in a toe-heel direction of the head defined between the parallel straight edges of the groove is 1 mm or more but 8 mm or less, wherein in the bottom view of the head, said groove as the rigidity-decreasing part in the sole portion has an extreme front end in the front semicircular edge and an extreme rear end in the rear semicircular edge, a straight line drawn between the extreme front end and the extreme rear end has an angle of 15 degrees or less with respect to the front-rear direction of the head, and the length of said groove as the rigidity-decreasing part in the front-rear direction is 10 to 30 mm so that said groove as the rigidity-decreasing part is larger in the front-rear direction than in the toe-heel direction, wherein in each said groove as the rigidity-decreasing part, a width in the toe-heel direction of the groove is smaller in a front portion defined as having the front semicircular edge and in a rear portion defined as having the rear semicircular edge than a portion between the parallel straight edges having said maximum width, wherein at least part of the front semicircular edge of said groove as the rigidity-decreasing part disposed on each of the toe side and the heel side of the central region of the crown portion, is visible in a front view of the golf club head, and the front view is a view when the golf club head in the reference state is viewed from the front of the head in the front-rear direction.

* * * * *